US005356180A

United States Patent [19]

Adasek

[11] Patent Number: 5,356,180

[45] Date of Patent: Oct. 18, 1994

[54] ADJUSTABLE LENGTH SKI GUARD

[76] Inventor: Kenneth P. Adasek, 11367 Nancy Dr., Warren, Mich. 48093

[21] Appl. No.: 16,468

[22] Filed: Feb. 11, 1993

[51] Int. Cl.[5] ..... A63C 11/00
[52] U.S. Cl. ..... 280/814; 280/815
[58] Field of Search ..... 280/814, 815, 11.26, 280/11.16, 825

[56] References Cited

U.S. PATENT DOCUMENTS

| | | | |
|---|---|---|---|
| 2,131,569 | 9/1938 | Reitan | 280/11.16 |
| 3,801,117 | 4/1974 | Pierce | 280/11.13 |
| 3,834,722 | 9/1974 | Rainer | 280/11.13 |
| 3,837,548 | 8/1974 | Nerger | 224/45 |
| 4,161,268 | 7/1979 | Heil | 224/45 |
| 4,191,233 | 3/1980 | McKay | 280/814 |
| 4,380,290 | 4/1983 | Luebke | 206/315 |
| 4,382,615 | 5/1983 | Gronberg et al. | 280/825 |
| 4,392,674 | 7/1983 | Evon | 280/825 |
| 4,645,228 | 2/1987 | Bertonneau | 280/603 |
| 4,772,047 | 7/1988 | Leaf | 280/815 |
| 5,066,044 | 11/1991 | Adasek | 280/815 |

FOREIGN PATENT DOCUMENTS

| | | | |
|---|---|---|---|
| 1552202 | 1/1969 | France | 280/814 |

*Primary Examiner*—Richard M. Camby
*Assistant Examiner*—Christopher P. Ellis
*Attorney, Agent, or Firm*—Reising, Ethington Barnard, Perry & Milton

[57] ABSTRACT

A ski guard assembly for use with skis of different lengths that have tip and tail end portions, sides, tops with top corners and bottoms with bottom edges includes an outboard and an inboard guard. The outboard guard has a channel that is closed at one end and open at an opposite end for removably receiving an end portion of a ski. The inboard guard has a assembly complimentary channel that is open at each end for removably receiving a portion of the ski adjacent the end portion of the ski. The inboard guard is slideably attached to the outboard guard so that it slides along the length of the ski to adjust to the length of the assembly when the outboard guard member is installed on the end portion of the ski. The ski guard assembly is secured to the ski by clamping the inboard guard onto the ski after the length adjustment is made.

19 Claims, 5 Drawing Sheets

ADJUSTABLE LENGTH SKI GUARD

BACKGROUND OF THE INVENTION

Background of the Invention

This invention relates to ski guards for shielding skis and more particularly to ski guards for protecting the end portions of the skis during transportation.

U.S. Pat. No. 5,066,044 granted to me Nov. 19, 1991 is hereby incorporated in this patent specification by reference. This patent discloses a ski guard assembly that includes two pairs of tip guard members and two pairs of tail guard members that combine to protect the metal edges, tops and corners of different length skis. Each of the guard members includes a base portion with two spaced side walls forming an open channel that captures the tips or the tails of the skis so as to protect the sharpened metal edges, tops and corners of the tips or tails against damage from foreign objects during transportation of the skis. Two pairs of straps cooperate with the ski guards to hold a pair of skis together and to hold the tips and tails of each ski within one of the guard members. The tip and tail guard members may also be integrated so that one tip guard holds and protects both tips and one tail guard holds and protects both tails.

These ski guards are configured and adapted for use with a wide range of ski lengths and types. They provide good impact protection for the top, bottom, top corners and metal edges of the skis at the most vital segments of the skis, namely the tip and tail portions of the skis where the metal edges are used to carve turns.

However, it has been found that it would be desirable to protect longer segments of the skis and to extend the range of ski lengths that can be protected by a given configuration.

SUMMARY OF THE INVENTION

The object of this invention is to provide a ski guard that protects a longer end portion at the tip or tail of a ski and/or extends the range of ski length that can be protected by a given configuration.

A feature of the ski guard of this invention is that the ski guard is adjustable in length so that the ski guard protect a longer tip or tail end portion of the ski and/or extends the range of ski lengths that can be protected by a given configuration.

Another feature of the ski guard of this invention is that the ski guard can be used with car top ski carriers designed to clamp onto the ski itself, can be used with ordinary ski bags or can be used with plastic bags supplied by airlines for shipping skis.

Another feature of the ski guard of this invention is that the ski guard can be adjusted to protect an entire end portion of a number of differing length skis up to a central binding area.

Still another feature of the ski guard of this invention is that the ski guard comprises an inboard guard that is slideably attached to an outboard guard for adjusting to the length of the ski and that is clamped to the ski after adjustment to hold the outboard guard in place.

Yet another feature of the ski guard of this invention is that the ski guard can be configured to accommodate a ski tip or a ski tail and that ski tip guards and ski tail guards can be used in conjunction with each other.

Still yet another feature of the ski guard of this invention is that the ski tip guard and the ski tail guard may each include a ski pole holder.

Still yet another feature of the ski guard of this invention is that the ski guard is easy to store when not in use.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 1:
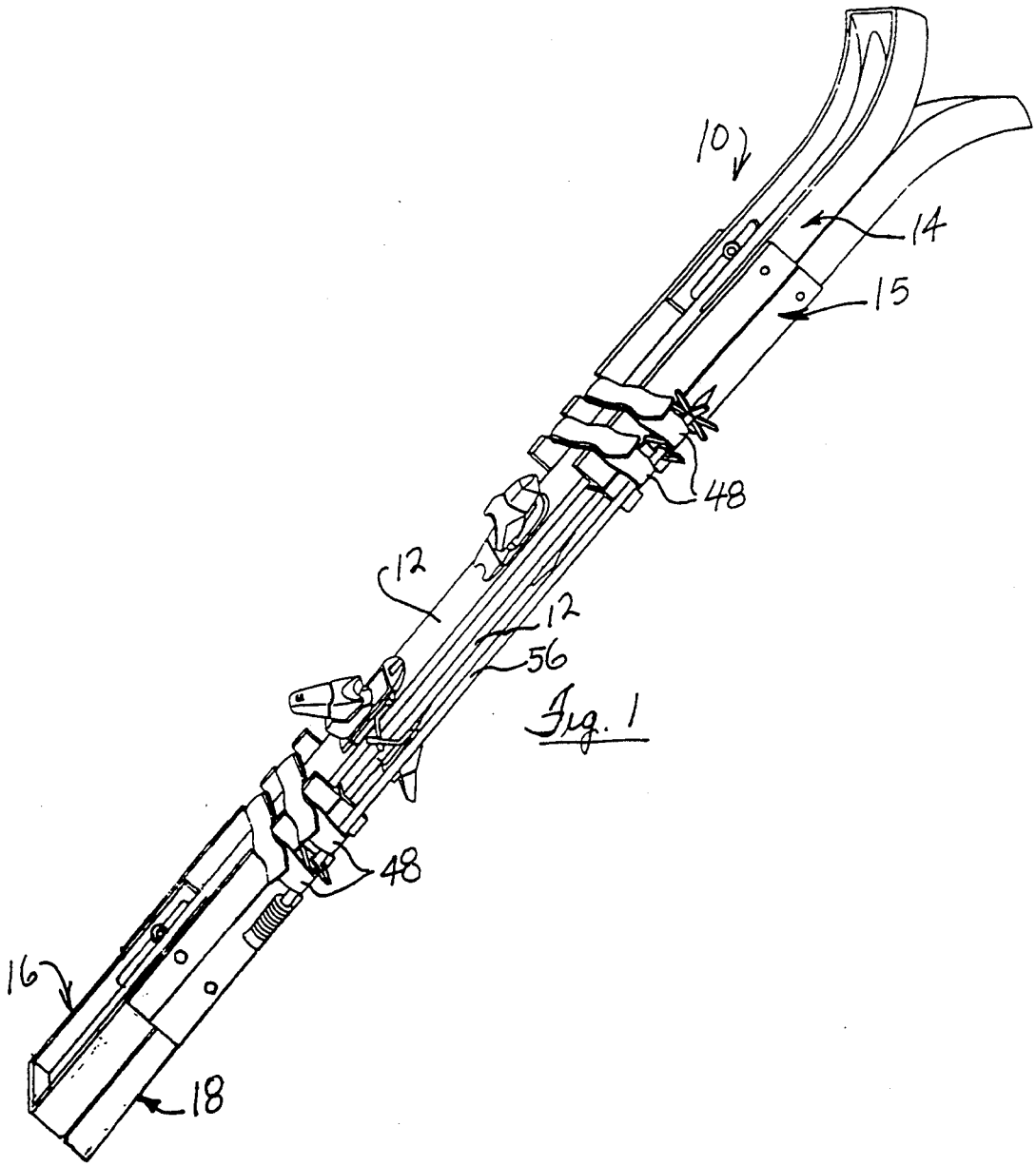
FIG. 1 is a perspective of ski guards of the present invention installed on a pair of downhill skis.

Referring now to the drawing and more particularly to FIG. 1, a full ski guard assembly 10 is illustrated assembled on a pair of skis 12. The ski guard assembly 10 includes a pair of ski tip guard assemblies 14, 15 and a pair of ski tail guard assemblies 16, 18.

Figure 2:
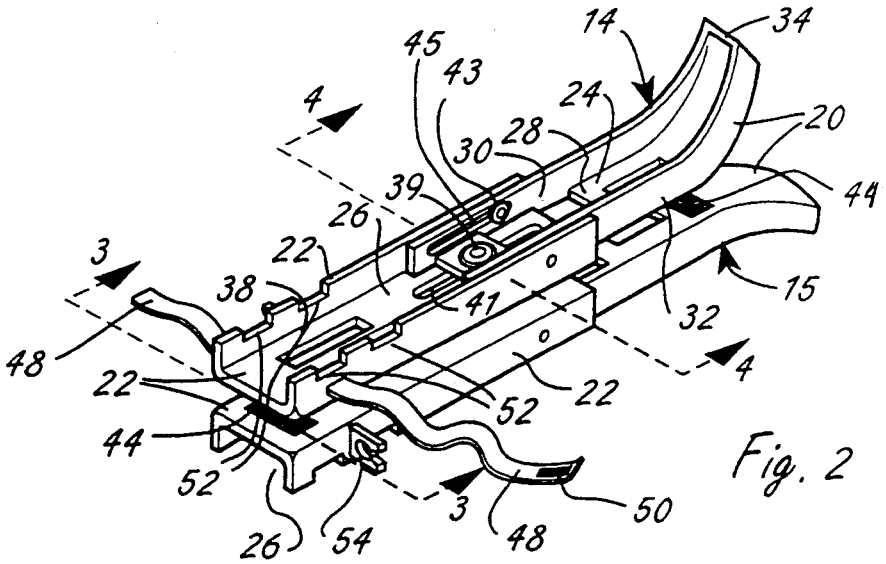
FIG. 2 is a perspective view of the ski tip guard shown in FIG. 1.
Figure 3:
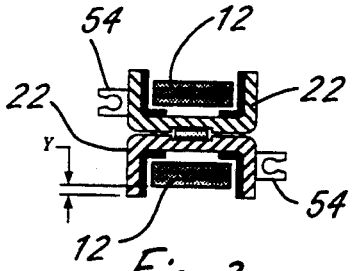
FIG. 3 is a sectional view taken along the line 3—3 of FIG. 2 looking in the direction of the arrows.
Figure 4:
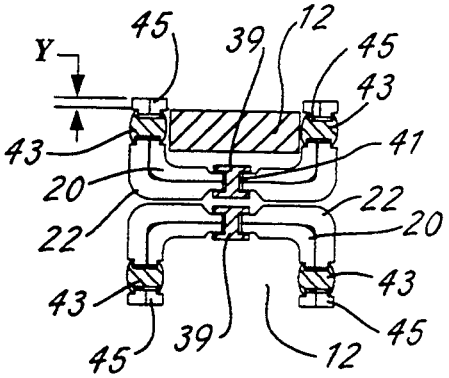
FIG. 4 is a sectional view taken along the line 4—4 of FIG. 2 looking in the direction of the arrows.
Figure 5:
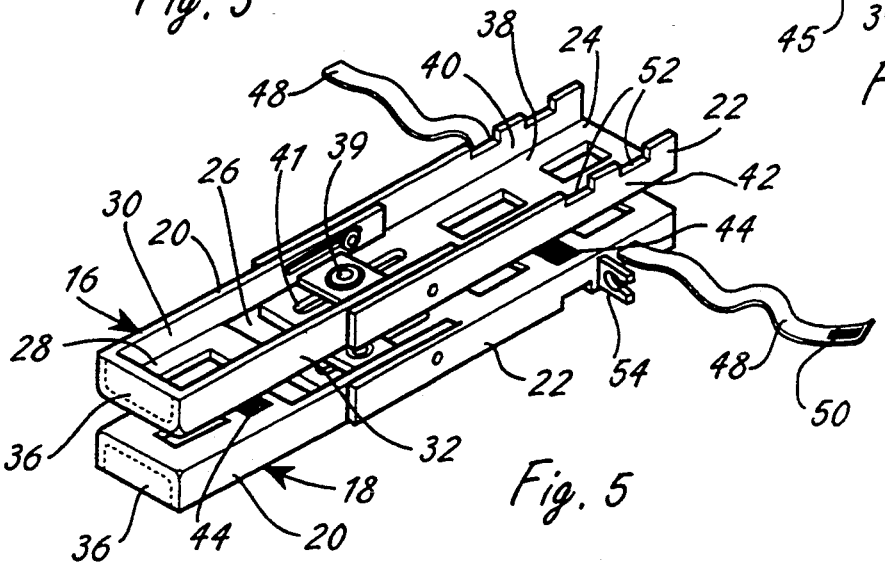
FIG. 5 is a perspective view of the ski tail guard shown in FIG. 1.

As shown in FIGS. 2 and 5 each of the ski tip guard assemblies 14, 15 and each of the ski tail guard assemblies 16, 18 are formed as separable units which are adapted to fit over the ends of a wide range of different length skis and each is preferably made of impact resistent hard plastic material such as ABS plastic that is easy to mold with known equipment.

Each of the ski tip guard assemblies 14, 15 and each of the ski tail guard assemblies 16, 18 comprise an outboard guard 20 and an inboard guard 22 that is slideably attached to it. Each outboard guard 20 has a channel 24 that is closed at one end and open at an opposite end for removably receiving an end portion of a ski, and each inboard guard 22 has a complimentary channel 26 that is open at each end for removably receiving a portion of the ski adjacent the end portion of the ski as shown in FIG. 1.

As shown in FIGS. 2, 3, 4 and 5 each of the outboard guards 20 includes a base wall 28 having integrally formed spaced side walls 30, 32 that are integrally joined to either a tip wall 34 or a tail wall 36 to form a closed end for the channels 24. On the other hand each of the inboard guards 22 includes a base wall 38 having integrally formed spaced side walls 40, 42 but no end walls so that the channels 26 are open at both ends.

The outboard guards 20 for the ski tip guard assemblies 14, 15 and the ski tail guard assemblies 16, 18 are nest inside their respective inboard guards 22 so that the side walls 30, 32 are juxtaposed inside the respective side walls 40, 42. Consequently all four inboard guards 22 are substantially identical and can be molded in the same die.

On the other hand, the assemblies can be designed so that the four inboard guards 22 of the same size nested inside their respective outboard guards 20 so that the side walls 30, 32 are juxtaposed outside the respective side walls 40, 42. These alternative inboard guards 22 can also be molded in the same die.

The means for slideably attaching the inboard guards 22 to the outboard guard 20 so that they slide along the length of the skis 12 when the outboard guards 22 are installed on the end portion of the ski comprises each base wall 38 having a longitudinal slot 41 that receives a pin 39 that is carried by the associated base wall 28 and that moves in the longitudinal slot 41 when an inboard guard 22 moves relative to an outboard guard 20 in the longitudinal direction.

The pin 39 is preferably a double headed rivet that has it heads below the outer surfaces of the base walls 28 as shown in FIG. 5 so that the pin 43 does not scratch the bottom of the ski or interfere with attaching two guard assemblies together.

The ski guard assemblies 14, 15, 16 and 18 include means to maintain a straight orientation of the outboard and inboard guards 20 and 22 with respect to each other. This includes the above pin and slot arrangement and further comprises the side walls 40, 42 of the inboard guards 20 being slideably attached to the respective side walls 30, 32 of the outboard guards 20 by pin and slot arrangements as shown in FIGS. 2 and 5. Specifically the outside side walls 40 and 42 carry pins 43 that extend inwardly into longitudinal slots 45 in the respective adjacent side walls 30 and 32. These pin and slot arrangements also assist in slideably attaching the inboard guards 22 to the outboard guards 20 so that they slide along the length of the skis.

The outboard guards 20 for the ski tip guard assemblies 14, 15 have curved end portions to accommodate the tip end portions of the skis 12 as shown in FIGS. 1 and 2 while the outboard guards 20 for the ski tail guard assemblies 16, 18 have straight end portions for accommodating the tail end portions of the skis 12 as shown in FIGS. 1 and 5.

Two ski tip guard assemblies 14, 15 are attached together with the channels 24, 26 of their respective inboard and outboard guards 20, 22 back-to-back as shown in FIGS. 1-5. The ski tip guard assemblies 14, 15 are preferably detachably secured together, for instance by VELCRO patches 44 on the bottom surfaces of the bottom walls 28 and 38. Two tail guard assemblies 16, 18 are secured together in like manner and preferably also include VELCRO patches 44 for detachably securing them together.

The tip guard assemblies 14, 15 are installed by inserting the tips of the skis in the outboard guards 20 and then adjusting the length of the tip guard assemblies 14, 15 by sliding the inboard guards 22 along the length of the skis. The pins 39 and 43 preferably have a tight tolerance so that any adjustment is held by friction. When the adjusted length is achieved, the inboard guards 22 are clamped to the skis 12 as shown in FIG. 1.

The inboard guards 22 are clamped to the skis 12 for example by flexible straps 48 that are integrally attached to a side wall 40 or 42 of each inboard guard 22 at one end. These flexible straps 48 are wrapped around the pair of skis 12 (and the pair of ski tip guard assemblies 14, 15) and are attached to themselves by VELCRO patches 50. The pair of ski tip guard assemblies 14, 15 is preferably clamped to the skis 12 by two clamping straps 48 which are disposed in two pairs of locking slots 52 in the side walls 40 and 42 when the straps 48 are in a clamping position.

The tail guard assemblies 16, 18 are installed on the tails of the skis 12 and clamped to the skis 12 in like manner.

The ski guard assemblies 14, 15, 16 and 18 each as an integral ski pole holder 54 in the form of a C-shaped clip. The integral ski pole holders 54 are preferably integrally attached to the side walls 40 and 42 of the inboard guards 22 so that a ski pole 56 may be carried in a protected position along each side of the pair of skis 12 as shown in FIG. 1. The ski pole holders 54 are also preferably between the pairs of locking grooves 52 so that the ski poles 56 can be clamped against the ski guards 14, 15, 16 and 18 by the flexible straps 48.

FIGS. 6-12 show a modified ski guard assembly that comprises one ski tip guard assembly 114 and one ski tail guard assembly 116 which are also adapted to fit over the ends of a wide range of different length skis. Each is also preferably made of impact resistent hard plastic material such as ABS plastic that is easy to mold with known equipment.

The ski tip guard assembly 114 and the ski tail guard assembly 116 each comprise an outboard guard 120 and an inboard guard 122 that is slideably attached to it. Each outboard guard 120 has a pair of back to back channels 124 that are closed at one end and open at an opposite end for removably receiving respective end portions of a pair of skis, and each inboard guard 122 has a pair of complimentary back-to-back channels 126 that are open at each end for removably receiving portions of the skis adjacent the end portions of the skis that are received into the outboard guard 120.

The outboard guard 120 include a base wall 128 having integrally formed spaced side walls 130, 132 that are integrally joined to either tip walls 134 or tail walls 136 to form a closed end for the channels 124. On the other hand each of the inboard guards 122 includes a base wall 138 having integrally formed spaced side walls 140, 142 but no end walls so that the channels 126 are open at both ends.

The outboard guards 120 for the ski tip guard assembly 114 and the ski tail guard assembly 116 are inside their respective inboard guards 122 so that the side walls 130, 132 are juxtaposed inside the respective side walls 140, 142. With this arrangement, the inboard guards 122 are identical and can be molded in the same die. This feature can also be achieved by designing both inboard guards 122 to nest in the outboard guards 120.

The means for slideably attaching the inboard guards 122 to the outboard guards 120 so that they slide along the length of the skis when the outboard guards 122 are installed on the end portions of the skis comprise each base wall 138 having a longitudinal slot 141 that receives a pin 139 that is carried by the associated base wall 128 and that moves in the longitudinal slot 141 when an inboard guard 122 moves relative to an outboard guard 120 in the longitudinal direction.

Figure 7:
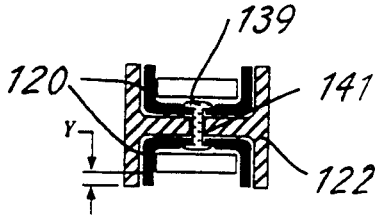
FIG. 7 is a sectional view taken along the line 7—7 of FIG. 6 looking in the direction of the arrows.

The pin 139 is preferably a double headed rivet that has its heads below the outer surfaces of the base walls 128 as shown in FIG. 7 so that the pin 139 does not scratch the bottoms of the skis.

The ski guard assemblies 114 and 116 include means to maintain a straight orientation of the outboard and inboard guards 120 and 122 with respect to each other. This includes the above pin and slot arrangement and further comprises aligned longitudinal slots 143 in the side walls 130 and 132 of outboard guards 120 slideably receiving the respective bottom walls 138 of the cooperating inboard guards 122. These wall and slot arrangements also assist in slideably attaching the inboard guards 122 to the outboard guards 120 so that they slide along the length of the skis.

Figure 6:
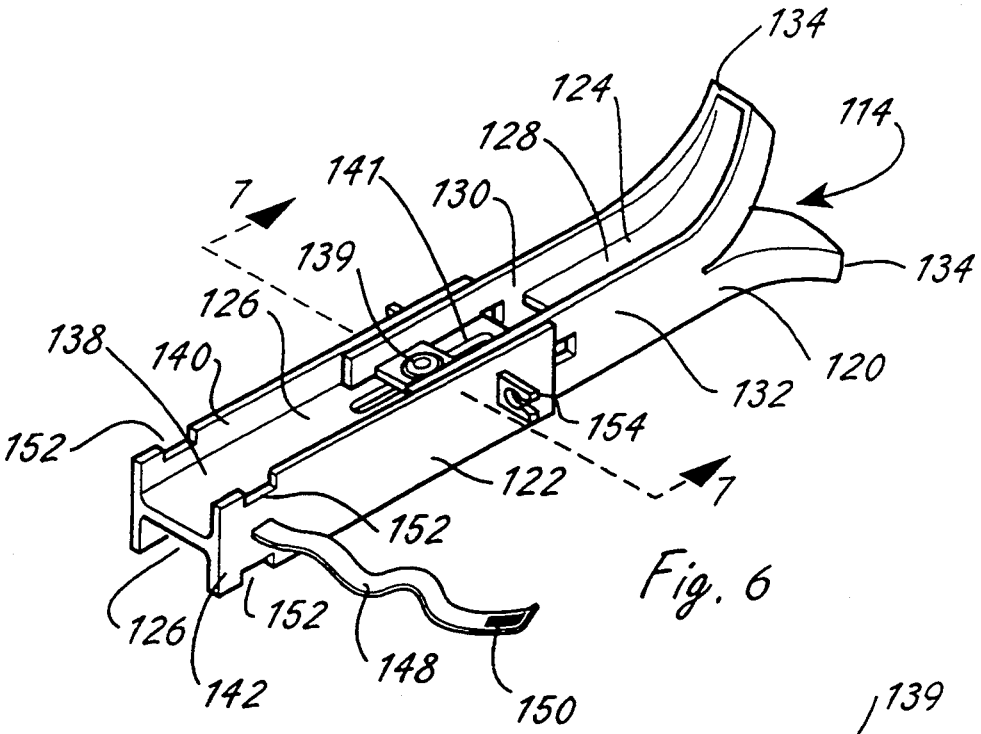
FIG. 6 is a perspective view of a ski tip guard in accordance with another embodiment of my invention.
Figure 11:
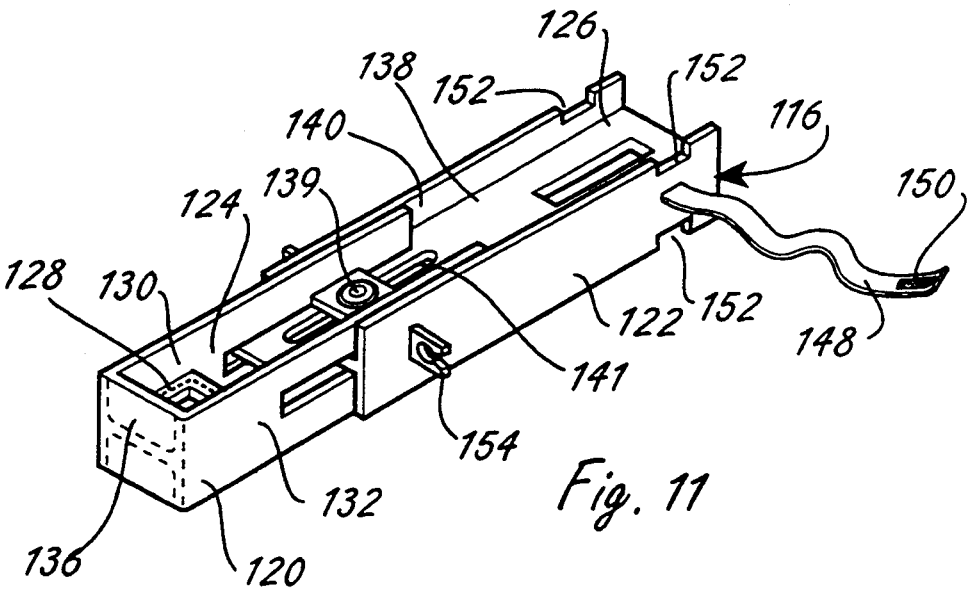
FIG. 11 is a perspective view of a ski tail guard in accordance with another embodiment of my invention.
Figure 8:
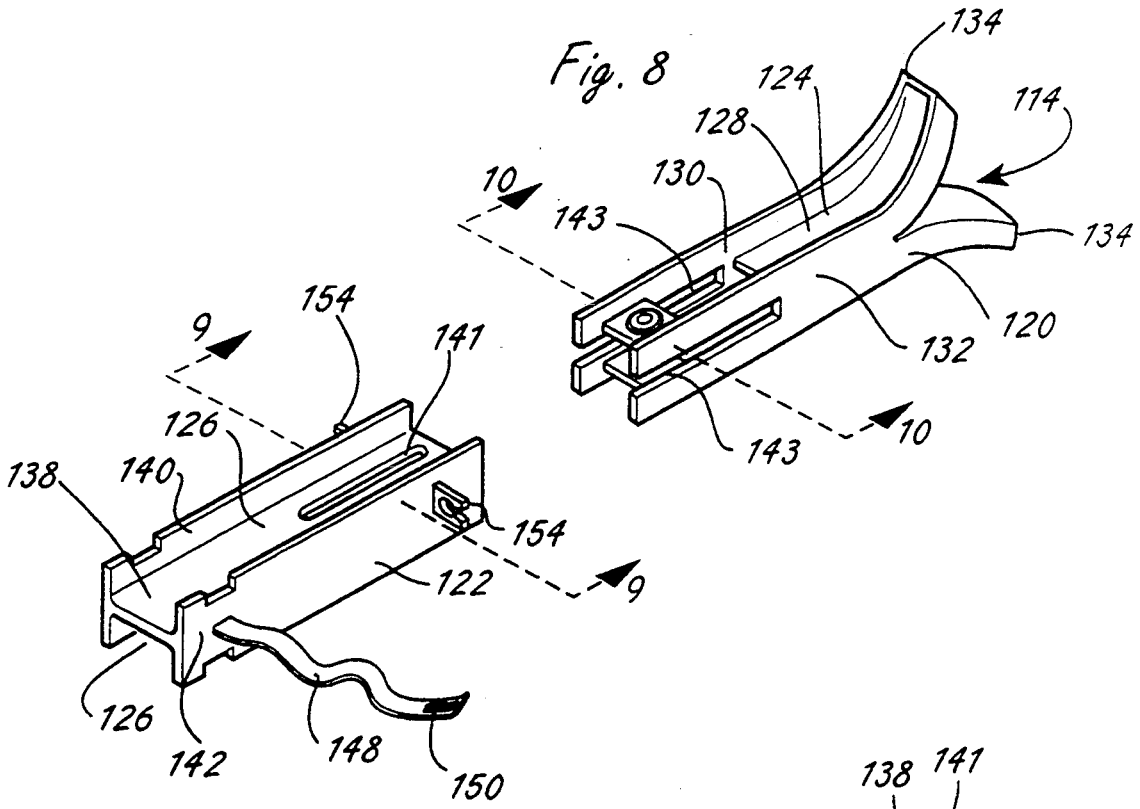
FIG. 8 an exploded perspective view of the ski tip guard that is shown in FIG. 6.
Figure 9:
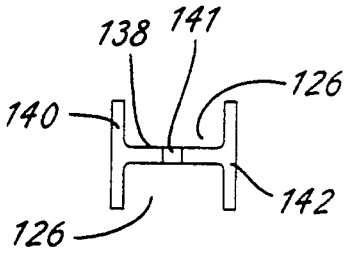
FIGS. 9 and 10 are sectional views taken respectively along the lines 9—9 and 10—10 of FIG. 8 looking in the direction of the arrows.
Figure 10:
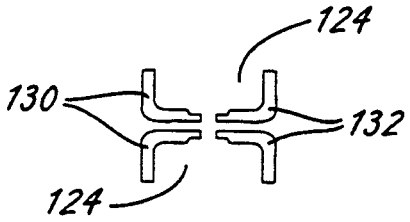
Figure 12:
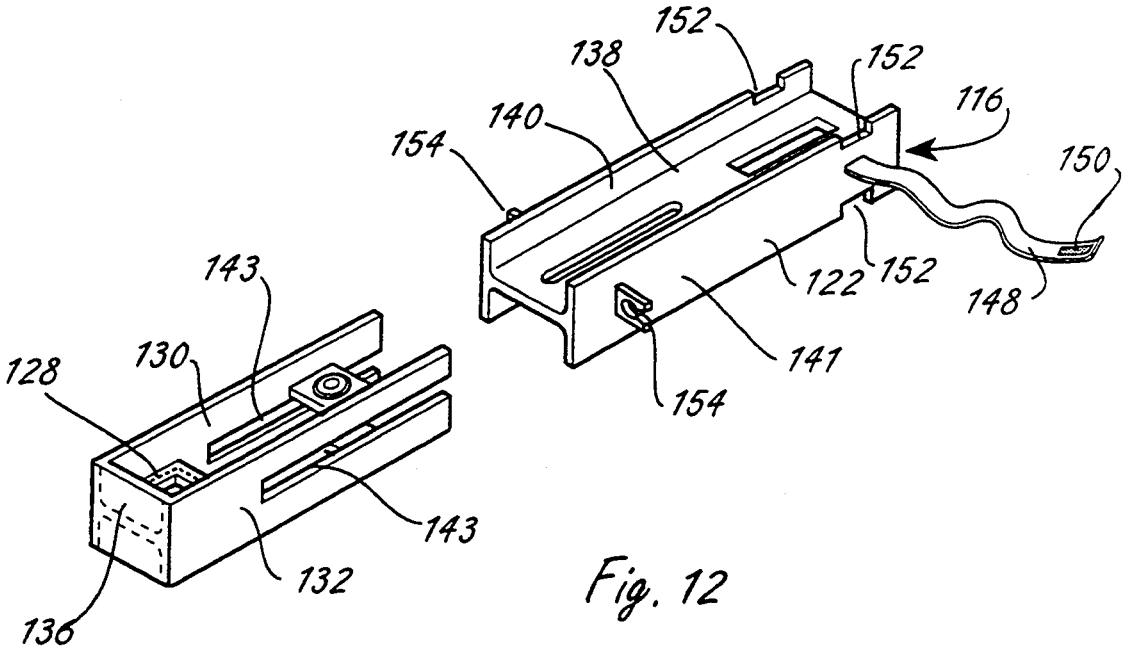
FIG. 12 is an exploded perspective view of the ski tail guard that is shown in FIG. 10.

The outboard guard 120 for the ski tip guard assembly 114 has a bifurcated end portion that is curved in opposite directions as shown in FIGS. 6 and 8 to accommodate the tip end portions of the a pair of skis arranged bottom to bottom as shown in FIG. 1. On the other hand, the outboard guard 120 for the ski tail guard assembly 116 has straight end portions as shown in FIG. 11 and 12 for accommodating the tail end portions of the skis.

The ski tip guard assembly 114 is installed by inserting the tips of a pair of skis (that are arranged as shown in FIG. 1) in the outboard guard 120 and then adjusting the length of the tip guard assembly 114 by sliding the inboard guard 122 along the length of the skis. Again the pins 139 preferably have a tight tolerance to hold the adjustment frictionally. When the adjusted length is achieved, the inboard guard 122 is then clamped to the pair of skis. In this case, the inboard guard 122 is clamped to the pair of skis by a single strap 148 that is integrally attached to a side wall 142 of the inboard guard 122 at one end. The strap 148 is wrapped around the pair of skis and attached to itself by a VELCRO patch 150 as before. The ski tip guard assembly 114 is preferably clamped to the pair of skis by a single clamping strap 148 which is disposed in a pair of locking slots 152 in the side walls 140 and 142 when the strap 148 is in a clamping position.

The tail guard assembly 116 is installed on the tails of the pair of skis and clamped to the pair of skis in like manner.

The ski guard assemblies 114 and 116 each have a pair of integral ski pole holders 154 in the form of C-shaped clips. The integral ski pole holders 154 are preferably on the side walls 140 and 142 of the inboard guards 122 so that ski poles may be carried in protected positions along each side of the pair of skis as before.

As demonstrated above, the ski guards of this invention are adjustable in length so that the ski guard protects a longer end portion at the tip or tail of the ski and/or extends the range of ski length that can be accommodated by a given configuration.

In fact, I have found that ski guards of a given configuration can adequately protect skis ranging in length from 175 to 210 centimeters which is the most popular range of length for expensive downhill racing skis.

Moreover, in most instances the adjustable length ski guards of this invention can be extended so that they protect the entire end portions of the skis up to the central binding carrying portion which is protected to some extent by the binding itself.

Furthermore, the adjustable length ski guards of this invention can be adjusted so that they do not interfere with conventional car top ski carriers that clamp onto the ski itself. The adjustable length ski guards of this invention can be also be used with ordinary ski bags or with plastic bags supplied by airlines for shipping skis. Consequently the adjustable length ski guard of this invention is also very versatile.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. A ski guard assembly for use with skis of different lengths that have tip and tail end portions, comprising, an outboard guard having a channel that is closed at one end and open at an opposite end for removably receiving an end portion of a ski, an inboard guard having a complimentary channel that is open at each end for removably receiving a portion of the ski adjacent the end portion of the ski, the outboard guard having a base wall with integrally formed spaced side walls that are integrally joined with a tip wall or a tail wall to form the closed end, the inboard guard having a base wall with integrally formed spaced side walls that are juxtaposed the side walls of the outboard guard, and means for slideably attaching the inboard guard to the outboard guard comprising one of the base walls having a longitudinal slot that receives a projection of the other base wall that moves in the longitudinal slot when the inboard guard moves relative to the outboard guard in the longitudinal direction so that it slides longitudinally of the ski when the outboard guard member is installed on the end portion of the ski, and the inboard guard having means for clamping the inboard guard onto the ski independently of the outboard guard.

2. A ski guard assembly for use with skis of different lengths that have tip and tail end portions, comprising, an outboard guard having a channel that is closed at one end and open at an opposite end for removably receiving an end portion of a ski, an inboard guard having a complimentary channel that is open at each end for removably receiving a portion of the ski adjacent the end portion of the ski, means for slideably attaching the inboard guard to the outboard guard so that it slides longitudinally of the ski when the outboard guard member is installed on the end portion of the ski, and the outboard guard having a base wall with integrally formed spaced side walls that are integrally joined with a tip wall or a tail wall to form the closed end, the inboard guard having a base wall with integrally formed spaced side walls that are juxtaposed the side walls of the outboard guard, and the means for slideably attaching the inboard guard to the outboard guard comprising one of the base walls having a longitudinal slot that receives a pin that is carried by the other base wall and moves in the longitudinal slot when the inboard guard moves relative to the outboard guard in the longitudinal direction.

3. The ski guard assembly as defined in claim 2 wherein the means for clamping the inboard guard onto the ski comprises a strap and locking grooves in the side walls of the inboard guard that receive the strap when it is in a clamping position.

4. The ski guard assembly as defined in claim 2 further including means to maintain a straight orientation of the guards with respect to each other.

5. The ski guard assembly as defined in claim 4 wherein the means to maintain a straight orientation of the guards with respect to each other comprises the side walls of the inboard guard being slideably attached to the respective outboard side walls of the outboard guard.

6. The ski guard assembly as defined in claim 4 wherein the means to maintain a straight orientation of the guards with respect to each other comprises the side walls of the one guard having aligned longitudinal slots that slideably receive the bottom wall of the other guard.

7. A ski guard assembly for use with skis of different lengths that have tip and tail end portions, comprising, an outboard guard having back-to-back channels that are closed at one end and open at an opposite end for removably receiving respective portions of the skis adjacent the respective end portions of the skis, an inboard guard having back-to-back complimentary channels that are open at each end for removably receiving respective portions of the skis adjacent the respective end portions of the ski, the inboard guard being slideably attached to the skis so that it slides along the lengths of the skis when the outboard guard is installed on the end portions of the skis, the outboard guard having a base wall with integrally formed spaced side walls that are integrally joined with a tip wall or a tail wall to form the closed end, the inboard guard having a base wall with integrally formed spaced side walls that are juxtaposed the side walls of the outboard guard, means for slideably attaching the inboard guard to the outboard guard comprising one of the base walls having a longitudinal slot that receives a projection of the other base wall that moves in the longitudinal slot when the inboard guard moves relative to the outboard guard in the longitudinal direction, and the inboard guard having means for clamping the inboard guard onto the skis independently of the outboard guard.

8. A ski guard assembly for use with skis of different lengths that have tip and tail end portions, comprising, an outboard guard having back-to-back channels that are closed at one end and open at an opposite end for removably receiving respective portions of the skis adjacent the respective end portions of the skis, the inboard guard being slideably attached to the skis so that it slides along the lengths of the skis when the outboard guard is installed on the end portions of the skis, and the inboard guard having means for clamping the inboard guard onto the skis, the outboard guard having a base wall with integrally formed spaced side walls that are integrally joined with tip walls or tail walls to form closed ends, the inboard guard having a base wall with integrally formed spaced side walls that are juxtaposed the side walls of the outboard guard, and one of the base walls having a longitudinal slot that receives a pin that is carried by the other base wall and moves in the longitudinal slot when the inboard guard moves relative to the outboard guard in the longitudinal direction.

9. The ski guard assembly as defined in claim 8 wherein the integrally spaced side walls of one of the guards each have an integral ski pole holder.

10. The ski guard assembly as defined in claim 8 wherein the outboard guard comprises separate outboard guard members for each ski that are fastened together back-to-back, the inboard guard comprises separate inboard guide members for each ski that are fastened together back-to-back, and the side walls of the separate inboard guard members are slideably attached to the respective outboard side walls of the respective outboard guard members to maintain a straight orientation of the guard members with respect to each other.

11. The ski guard assembly as defined in claim 10 wherein the means for clamping the inboard guard onto the skis comprises a strap that is attached to each separate inboard guard member and two sets of locking grooves in the side walls of the each separate inboard guard member that receive the respective straps when they are in clamping positions.

12. The ski guard assembly as defined in claim 8 wherein the outboard guard and the inboard guard are each of one piece construction, and the side walls of one guard have aligned slots that slideably receive the bottom wall of the other guard to maintain a straight orientation of the guards with respect to each other.

13. The ski guard assembly as defined in claim 12 wherein the means for clamping the inboard guard onto the ski comprises a strap that is attached to the inboard guard and locking grooves in the side walls of the inboard guard that receive the strap when it is in a clamping position.

14. The ski guard assembly as defined in claim 8 wherein the outboard guard has curved end portions for receiving tip end portions of the skis.

15. The ski guard assembly as defined in claim 8 wherein the outboard guard has straight end portions for receiving tail end portions of the skis.

16. The ski guard assembly as defined in claim 1 further including means to maintain a straight orientation of the guards with respect to each other.

17. The ski guard assembly as defined in claim 16 wherein the means to maintain a straight orientation of the guards with respect to each other comprises the side walls of the inner guard being slideably attached to the respective side walls of the outer guard.

18. The ski guard assembly as defined in claim 16 wherein the means to maintain a straight orientation of the guards with respect to each other comprises the side walls of one guard having longitudinal slots that slideably receive projections of the side walls of the other guard.

19. The ski guard assembly as defined in claim 16 wherein the means to maintain a straight orientation of the guards with respect to each other comprises the side walls of the one guard having aligned longitudinal slots that slideably receive the bottom wall of the other guard.

* * * * *